US005709494A

United States Patent [19]

Deutsch

[11] Patent Number: 5,709,494

[45] Date of Patent: Jan. 20, 1998

[54] BINDER WITH IMPROVED MODULAR BACKSTRIP DESIGN

[76] Inventor: Anton Deutsch, Alois Groggergasse 22, Gleisdorf, Austria, A-8200

[21] Appl. No.: 632,459

[22] PCT Filed: Oct. 18, 1994

[86] PCT No.: PCT/AT94/00151

§ 371 Date: Jul. 18, 1996

§ 102(e) Date: Jul. 18, 1996

[87] PCT Pub. No.: WO95/11136

PCT Pub. Date: Apr. 27, 1995

[30] Foreign Application Priority Data

Oct. 19, 1993 [AT] Austria ..... 2099/93

[51] Int. Cl.[6] ..... B42F 3/00

[52] U.S. Cl. ..... 402/60; 281/36

[58] Field of Search ..... 402/60–63, 68, 402/46, 47, 56, 500; 412/38; 281/36

[56] References Cited

U.S. PATENT DOCUMENTS

| | | | |
|---|---|---|---|
| 1,372,161 | 3/1921 | Mills . | |
| 1,805,314 | 5/1931 | Morton | 281/36 |
| 2,083,434 | 6/1937 | Crump | 281/36 |
| 2,315,303 | 3/1943 | Unger | 402/47 |
| 4,730,950 | 3/1988 | Omniato | 402/48 |
| 5,593,243 | 1/1997 | Mori | 402/46 |

FOREIGN PATENT DOCUMENTS

WO92/15461 9/1992 WIPO .

*Primary Examiner*—Daniel W. Howell
*Assistant Examiner*—G. Albert Andoll
*Attorney, Agent, or Firm*—Jacobson, Price, Holman & Stern, PLLC

[57] ABSTRACT

A binder which can be opened on both sides, comprising a modular backstrip and two side parts, each side part being detachably connected to either side of the modular backstrip. Said side parts are detachable connected to each other with mounting posts and matching insertion holes. Said side parts detachably connected to the modular backstrip with insertion elements and matching recesses. Slide lock means are also provided.

3 Claims, 1 Drawing Sheet

BINDER WITH IMPROVED MODULAR BACKSTRIP DESIGN

Figure 1:
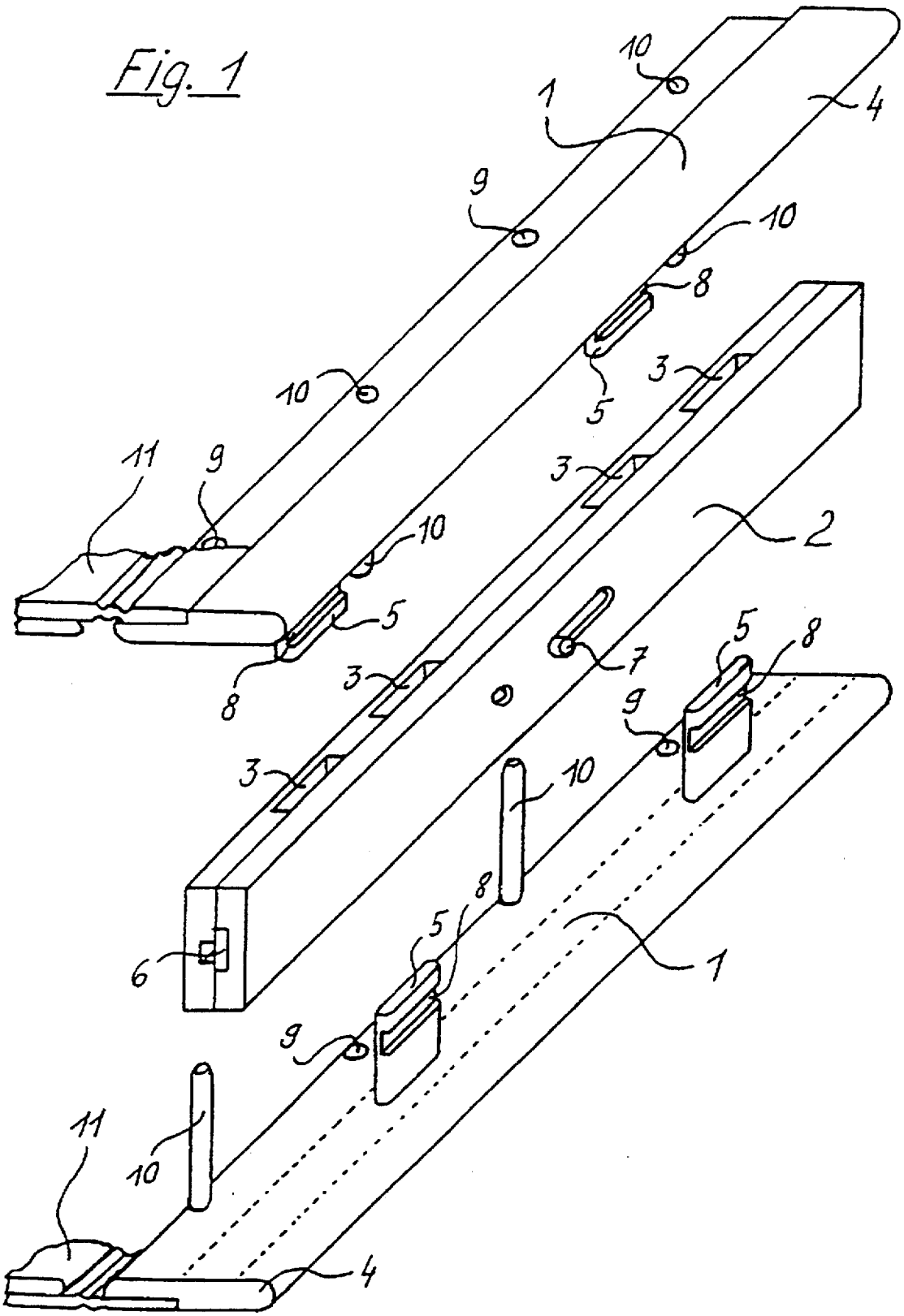

Binders are used for the book-like presentation and storage of objects or information mounted or contained on sheet-like data carriers. The present invention relates to binders constructed according to the modular backstrip principle. Such binders are described in WO 92/15 461.

Not only has the modular backstrip design been considerably improved in the present invention, but also new uses and applications have been created for this backstrip.

The principal feature of binders of the kind described in WO 92/15 461 is that the binder is closed off at the rear by an additional modular backstrip. In FIGS. 1 to 4 contained in WO 92/15 461, the actual modular backstrip and also the mounting posts for the punched data carriers are permanently attached to the side part. The opposite side part contains the insertion elements which fit into the recesses on the modular backstrip. On the side part are also located the insertion holes into which the heads of the mounting posts attached to side part engage. According to Claim 1 of WO 92/15 461, the insertion elements may be mounted optionally on side part or on side part.

Binders manufactured according to WO 92/15 461 already possess excellent sturdiness. At the point where the binder is opened, it is possible to read the two pages presented, as in a book, and also if necessary to write on them without hindrance, because there are no upward-projecting rings, locking hoops or other locking mechanisms to get in the way. Furthermore, there is no risk of the user being injured by the sharp ends of mounting posts of the kind used in particular in some types of ring binder mechanisms. Softer and thinner kinds of paper may be used as the data carriers because, as a result of the larger diameter of the mounting posts, there is much less risk of the paper tearing in the area of the punched hole. Thinner papers not only make it easier to turn the pages, but also greatly increase the storage capacity of the binder. Therefore, the paper costs are also indirectly reduced. Without the binder covers, the modular backstrip be adapted for storage in a hanging file system. Furthermore, when they are not quite or only partially full, modular backstrip binders of the type described in WO 92/15 461 do not require a separate clamping device to press the filed data carriers together. This is true, in particular, in the case of modular backstrip binders having four mounting posts arranged at spacings corresponding, for example, to the standard spacings used in four-ring binders. In modular backstrip binders which are not quite full, the information content is in fact better accessible than when the storage capacity is fully utilized. The rings of different thickness and curvature found, in particular, in ring binders, are dispensed with. This is particularly advantageous when the binders are stored in filing cabinets, etc. In addition, for binders of all widths, a standard hole diameter can be selected for the data carriers if the diameter of the mounting posts remains the same for backstrips of all widths. The actual, inside width of the binder can be used to its fullest extent for storage purposes because the tips of the mounting posts project into the insertion holes in the side part. The mounting posts are therefore always slightly longer than the actually available usable space. This therefore eliminates the often considerable amount of "dead space" caused by the mechanisms between the covers of the binder and the mounting mechanisms, or between the covers and the actual usable space allowed by the various individual mechanisms.

Despite the advantages listed above, there are still some weak points in the design of the modular backstrip binders of the type described in WO 92/15 461:

1. Like quick-release files, binders of the kind described in WO 92/15 461 can only be opened on one side, because the modular backstrip 2 is firmly attached either to side part or to side part. In the drawings to, it is in all cases side part to which the modular backstrip is attached. Therefore, new sheets can be added or removed only at the respective opposite side, by passing them over the free, upward-projecting ends of the mounting posts. This means that the modular backstrip binder can be opened either only at the front or at the back, depending on the side part to which the modular backstrip is attached. If the modular backstrip is attached to side part, this determines that material can be filed only in a particular sequence because the backstrip binder can be opened only at the front. If, however the modular backstrip is attached to side part, the modular backstrip binder can be opened only at the back. This permits material to be added only from the rear, in a book-like chronological sequence, which is desirable, for example, when filing newspapers. Therefore, as already mentioned, in the embodiment according to WO 92/15 461, no provision is made for the binder to be opened optionally at the front or at the back.
2. Another problem still exists with the binder design according to WO 92/15 461 in contrast to ring binders or binders with lever mechanisms: It is not possible to remove or add data carriers (pages) at any desired point in the filed stack. In order to do this, it is first necessary, as is the case with quick-release files, to lift all the overlying "pages" off the mounting posts. This creates the risk that the part of the stack no longer securely held in place by the mounting posts might get out of order. In addition, this operation takes a long time.
3. In the case of the binder configuration described in WO 92/15 461, two differently designed side parts must be produced because one side part is always permanently attached to the modular backstrip 2. This design is also necessary because only one side part is equipped with mounting posts, and the respective opposite side part is equipped only with the insertion holes which accept the heads of the mounting posts. This makes it more difficult and expensive to produce, assemble and store the binders. Therefore, in the case of the design according to WO 92/15 461, it is not possible to use a standard side part which fits either at the "front" or at the "back" of the binder, thereby also reducing the production costs because it exists in only one configuration. In addition, the actual modular backstrip cannot be selected in a simple manner, independently of the configuration of the side part because, for example, it may be desired that the backstrip should exhibit other variations of shape or colour.

The improved modular backstrip design eliminates the aforementioned, still existing disadvantages of the modular backstrip binder configuration according to WO 92/15 461.

The binder can be opened on both sides, and the modular backstrip can be designed more independently of the side part by designing the backstrip as a separate, loose component which is not permanently joined to any side part.

Even if the modular backstrip binder is designed with a narrow back, the side parts can still be of standard design by ensuring that the insertion elements on the side parts are not symmetrically arranged but laterally offset in relation to each other, and the opposite flank sections of the modular backstrip possess matching insertion recesses. As a result, the insertion elements are also laterally offset but arranged adjacent to each other in a modular backstrip of narrow configuration.

If more than two mounting posts are used per binder, it is in fact possible to remove or add suitably punched data carriers at any desired point in an already existing stack of filed data carriers. This goal of the invention is attained by alternatingly arranging the mounting posts and the respective opposite insertion holes at the desired spacings on the side parts. When the stack of data carriers is lifted off above the desired point, the data carriers are held securely in the existing filed sequence by the mounting posts fitted at the upper lateral edge and passing through the stack from above. This purpose is particularly well served by a variant with four mounting posts, corresponding to the four-ring binder configuration, only two of which posts are permanently attached to one side part while the other two are attached to the other side part. Only this variant of the design is depicted in FIG. 1. FIG. 1 is an exploded view of the device.

In the illustrative drawing, which consists solely of FIG. 1, the variant referred to above is depicted as one of many possible embodiments of the present invention and then described, to the extent that this is necessary. The characteristics of the invention as described in WO 92/15 461 are not discussed any further and it is assumed that they are known.

The reference numbers are assigned to the following features of the design: 1—strip-like side parts of completely identical design; 2—loose modular backstrip which is not permanently attached to either side part; 3—suitable recesses provided on the two opposing flank sections of the modular backstrip to receive the insertion elements 5 projecting from the side parts; 4—the preferably rounded outer edge of the side parts; 6—a locking slide provided in the modular backstrip and consisting of a sliding element 7 and engagement parts, not visible here, which engage in the matching recesses 8 on the insertion elements (for wide modular backstrips at least two locking slides 6 are required; in all cases, they run parallel to and at the same distance from both flank sections of the modular backstrip 2 so that side parts 1 and insertion elements 5 of standard design can be used in binders having backs of different width); 10—strong mounting posts of tubular or solid cross-section and insertion holes 9 which accept the ends of the mounting posts, said holes being arranged alternatingly and asymmetrically on the side parts; 11—indicates a book-type binder cover directly joined via a hinge to the strip-shaped side parts.

In the embodiment shown here, with four mounting posts 10 per binder, both the opposite side parts 1 are completely identical in design because the side parts 1 can be used on either side. Thus, not only the insertion elements 5 but also the mounting posts 10 and the insertion holes 9 are asymmetrically arranged on the side part 1. This means that each side part 1 is provided with two equally asymmetrically arranged mounting posts 10 and, alternating therewith, two likewise asymmetrically arranged insertion holes 9 for the ends of the mounting posts 10 attached to the respective opposite side part.

In addition to the variant of the design depicted in the drawing, there are many other embodiments, not shown here, of the features of the invention referred to in Claims 1 to 3, relating in particular to the design of the locking slides 6 and the arrangement or the number of mounting posts 10 and insertion holes 9.

I claim:

1. A binder having a modular backstrip of improved design for the presentation and storage of objects or information mounted or contained on sheet-like data carriers, in which the back section consists of an additional modular backstrip forming the actual back of the binder, and also of two opposed, strip-like side parts connected with the modular backstrip, and the said modular backstrip is provided with one or more lock slides fitted with a sliding element and matching recesses for the insertion elements projecting from the two strip-like side parts, and the said insertion elements are themselves provided with matching recesses for the engaging elements fitted on the lock slides, and the said side parts also carry robust mounting posts of tubular or solid cross-section as well as insertion holes into which the ends of the mounting posts are introduced, characterized in that the modular backstrip is designed as a separate, loose component that is not permanently attached to any side part.

2. The binder having an improved modular backstrip according to claim 1, characterized in that the insertion elements are not arranged symmetrically but are laterally offset on the side parts and the opposite flank sections of the modular backstrip possess matching recesses.

3. A binder having an improved modular backstrip according to claim 1, characterized in that the mounting posts and the respective opposite insertion holes on the side parts are alternatingly arranged at the desired spacings.

* * * * *